United States Patent [19]

McLaughlin et al.

[11] 4,173,466

[45] Nov. 6, 1979

[54] MAGNESIUM-CONTAINING TREATMENT AGENTS

[75] Inventors: John R. McLaughlin; Michael D. Bryant, both of Birmingham, England; Manfred Fessel; Kenneth C. Taylor, both of Borken, Fed. Rep. of Germany

[73] Assignee: Foseco International Limited, Birmingham, England

[21] Appl. No.: 857,897

[22] Filed: Dec. 6, 1977

[30] Foreign Application Priority Data

Dec. 6, 1976 [GB] United Kingdom ..... 50847/76
Feb. 11, 1977 [GB] United Kingdom ..... 5807/77

[51] Int. Cl.[2] ..... C21C 7/02

[52] U.S. Cl. ..... 75/58; 75/53; 75/130 R

[58] Field of Search ..... 75/53, 58, 130 R, 130 A, 75/130 AB

[56] References Cited

U.S. PATENT DOCUMENTS

| | | | |
|---|---|---|---|
| 2,762,705 | 9/1956 | Spear | 75/130 AB |
| 2,837,422 | 6/1958 | Motz | 75/130 AB |
| 3,953,198 | 4/1976 | Easwaran | 75/53 |
| 3,961,663 | 6/1976 | Degois | 164/58 |
| 4,086,086 | 4/1978 | Dawson | 75/130 AB |

*Primary Examiner*—P. D. Rosenberg
*Attorney, Agent, or Firm*—Cushman, Darby & Cushman

[57] ABSTRACT

Treatment agents are described for use in nodularizing cast iron in the production of ductile iron and also useful in deoxidizing steel and desulphurizing cast iron. The agents take the form of a compacted mixture comprising particulate iron, magnesium and calcium, and are distinguished by (a) a magnesium content of 5 to 15% by weight
(b) a weight ratio of magnesium to calcium in the range of from 1:1 to 8:1
(c) the iron having a purity of at least 95% by weight and a particle size of all less than 0.5 mm and
(d) being compacted into a body of density at least 4.3 gm/cm$^3$.

The high density allows the agent to be used effectively by a simple overpour technique.

13 Claims, 2 Drawing Figures

Figure 1:
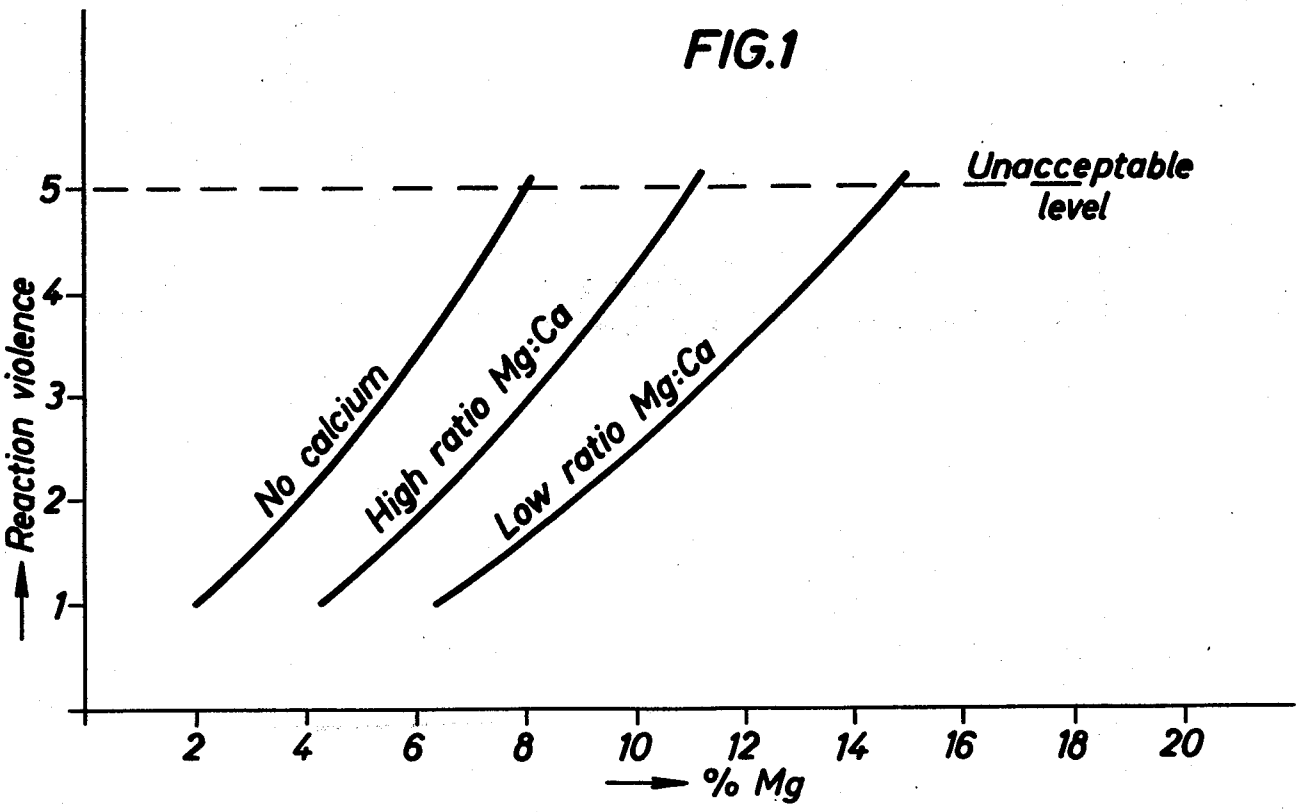

Unacceptable level
No calcium
High ratio Mg:Ca
Low ratio Mg:Ca
Reaction violence
5
4
3
2
1
2
4
6
8
10
12
14
16
18
20
% Mg

MAGNESIUM-CONTAINING TREATMENT AGENTS

This invention relates to treatment agents useful in the production of nodular cast iron (also called "ductile iron" and "SG iron", and to the process of nodularisation in the course of production of cast iron. It also relates to the deoxidation of steel and desulphurisation of iron.

The essential steps in the production of ductile iron from a base metal of roughly grey iron composition (carbon 3.5 to 4.0%, silicon 1.5 to 2.5%, sulphur 0.03 to 0.15%) are sequentially, desulphurisation, nodularisation and inoculation. Nodularisation is preferably carried out by introducing magnesium into the molten iron.

Magnesium cannot be introduced into iron for nodularisation until the sulphur content in the molten iron has been reduced below about 0.01%, preferably below 0.005%, when the addition of magnesium results in a build-up of magnesium in the iron to the level necessary for the production of spheroidal graphite. In practice, desulphurisation is carried out as a separate step prior to nodularisation. Known desulphurising agents for the purpose are calcium carbide, sodium carbonate, and calcium oxide. After desulphurising, the sulphur-containing slag is removed and the molten iron is ready for the treatment with magnesium for nodularisation.

Magnesium is a difficult element to introduce into molten iron for nodularisation since in its pure state it has a boiling point (1070° C.) well below the temperature of molten iron, a low solubility in iron, much lower density than iron (1.7 for magnesium compared with over 7.0 for cast iron) and a high tendency to be lost as magnesium oxide or magnesium vapour.

A variety of means of overcoming the problems inherent in the introduction of magnesium into iron for nodularisation has been suggested over the 30 years that have elapsed since the invention of ductile iron. Some of the most important are as follows:

1. By the use of special equipment: for example by applying magnesium in the form of powder or granules by injection or combining the magnesium with inert materials such as coke or sponge iron and plunging these products into molten iron by means of a special plunger, or using special treatment vessels where pure magnesium is introduced under a pressure greater than atmospheric.
2. By alloying the magnesium with a denser material and then by pouring the molten iron on to the alloy so formed. Both nickel and copper have been used for this purpose, but their use is no longer common because of cost and because of the effect of their presence on the metallurgical properties of the cast iron. Instead it is now popular to use as the denser material ferrosilicon—for example a ferrosilicon composition containing from about 5% to about 10% of magnesium. The use of ferrosilicon does, however, have severe disadvantages since the presence of silicon, especially if allowed to reach relatively high values, can cause problems in later stages of manufacture of cast iron. As an example, the final content of silicon in the final nodular iron should be of the order of 2.5%, and this imposes restraints on the desirable content of silicon at earlier stages of manufacture. If the level rises too greatly it may be necessary to take remedial action. Further, the presence of silicon can give rise to the formation of siliceous slags, which should be removed. Also, the reaction between magnesium in the ferrosilicon composition and the molten iron can be violent, even in the narrow range of 5 to 10% content of magnesium.

Simple ladle addition using over-pour or sandwich techniques with 5% or 10% magnesium ferrosilicon (or less often nowadays, nickel magnesium) is the most widely used method of introducing magnesium in the absence of special equipment.

Inoculation is an extremely important part of ductile iron production. It is necessary first to increase the number and improve the compactness of the graphite spheroids resulting from the magnesium treatment and secondly, to prevent the occurrence of chill (formation of iron carbide) especially in thin sections. Thus the inoculant must be added after the magnesium treatment and not before, if it is to be effective. It is essential to choose a suitable inoculant and generally a ferrosilicon alloy is used. Thin section castings with low silicon content and high pouring temperatures require high levels of inoculation to avoid chill and obtain satisfactory graphite structure. The usual method of addition is to add the inoculant to the molten iron stream during transfer of nodularised molten cast iron into the pouring ladle. In another procedure, so called "mould inoculation", an inoculating agent is mechanically secured to the bottom of the casting mould and the molten iron is poured thereon. This is often practised as an inoculation additional to an inoculation step in the ladle.

A variety of magnesium containing compositions which can be compacted to form compacts for nodularisation has been proposed. German Patent specification No. 1,302,000 teaches the use of a briquette which contains 7 to 25% magnesium, balance pulverised iron, and optional additives; one additive is calcium carbide. Compacts made according to the teachings of this specification and including calcium carbide deteriorate on exposure to the atmosphere. The briquette may also contain bismuth oxide and calcium. German Patent specification No. 1,758,468 and equivalent British Patent specification No. 1,201,397 propose a compact comprising 4 to 40%, preferably 5 to 25%, of magnesium, balance sponge iron, and having a density of 2 to 4 gm/cc, preferably 3 gm/cc. Such compacts are of low density and tend to float on top of the molten iron, leading to a magnesium recovery unacceptably low, unless special apparatus is used, for example an immersion ladle as mentioned in the specification or a plunger which holds the compacts down.

British Patent specification No. 1,364,859 discloses for deoxidising steel a briquette of magnesium and sponge iron, in the form of a block weighing e.g. 1 kg; such briquettes can only be used effectively for the nodularisation of cast iron if apparatus is used to counteract their tendency to float upon the molten cast iron. British Patent specification No. 1,397,600 discloses the use of briquettes of 5 to 7% magnesium, 0.3 to 0.9% cerium and balance iron for nodularising cast iron. Such briquettes have to be held on the bottom of the ladle to secure the desired effect, e.g. by covering them with more than their own weight of metal punchings.

U.S. Pat. No. 1,922,037 discloses briquettes of a reactive metal such as calcium or magnesium and a relatively less reactive metal such as iron. Such briquettes are useful for various purposes, though their use in nodularisation of cast iron is not proposed, as ductile iron had not been invented in 1930 when the specification was written. U.S. Pat. No. 3,459,541 discloses briquettes of magnesium and iron, for nodularisation. In order to secure effective nodularisation it is necessary to use plunging apparatus or other special devices to hold the briquettes in the molten metal.

British Patent specification No. 799,972 is concerned with nodularisation by means of an agent which is plunged into the molten metal. The agent comprises by weight 17 to 50% magnesium, 2.8 to 10% calcium, at least 35% silicon and between 0% and 30% of iron. The specification discloses that provided that magnesium:-calcium ratio is in the range of 5.7:1 to 9:1, then the calcium reduces the violence of the reaction. These agents are plunged into the molten metal by means of a plunger.

It is known from published Swedish Patent Application 241/70 to use in the inoculation step in the production of cast iron, an inoculating composition comprising an inoculating agent and particulate sponge iron compacted together. The inoculating agent can be a variety of materials including for example a calcium-silicon-magnesium alloy or a magnesium-iron-silicon alloy. The compacts are made by pressures of 2 to 3 tonnes/cm, and experience has shown that such compacts have a density of 3.8 to 4 gm/cm$^3$. In order that these compacts do not float upon the molten iron, it is customary mechanically to secure the compacts of the inoculating composition within the mould, for example by nailing them in place or by wedging them in place. This permits the release of the silicon to perform the inoculation. For inoculation, such compacts are used at very low addition rates relative to the molten metal.

It has now been discovered that it is possible to make compacted tablets of magnesium, calcium and iron, which can be used in an "overpour" technique to nodularise molten cast iron, without the need to provide special apparatus to hold the tablets in the molten metal. In order to secure these desirable properties, including a low reaction violence and high magnesium recovery, the ratio of the magnesium to calcium must lie within a certain range, and the density of the tablet must exceed a minimum value. The content of calcium should be adjusted relative to the magnesium such that sufficient will be present to moderate the violence of the reaction of the magnesium with the molten iron, but care must be taken that there is not too much calcium or the tablet will have too low a density. If the density is too low, in the absence of a plunger or the like, the tablets simply float upon the molten iron and the magnesium escapes as vapour and accordingly does not exert any nodularising effect.

According to a first feature of the present invention there is provided a treatment agent for treating molten metal which is a compacted mixture comprising particulate iron, magnesium and calcium, wherein (i) the magnesium content is from about 5 to about 15% by weight and the magnesium is of particle size all less than 0.7 mm,
(ii) the weight ratio of magnesium to calcium is in the range of from 1:1 to 8:1,
(iii) the iron has a purity of at least 95% by weight and a particle size of all less than 0.5 mm, and
(iv) the mixture is compacted into a body of density of at least about 4.3 gm/cc.

Such agents are of particular value in nodularising cast iron in a metallurgical vessel. According to a specific feature of the invention, there is provided a method of nodularising cast iron which comprises locating in a metallurgical vessel at least one tablet (usually several) of a treatment agent as defined above, and pouring cast iron therein.

The treatment agent may also be used to desulphurise iron or to deoxidise steel, similarly by locating a suitable quantity on the base of a vessel such as a ladle and pouring the molten iron or steel over the treatment agent. In deoxidation and desulphurisation applications, it is preferred that the ratio of magnesium or calcium is at the low end of the 1:1 to 8:1 range, e.g. from 1:1 to 3:1.

Figure 2:
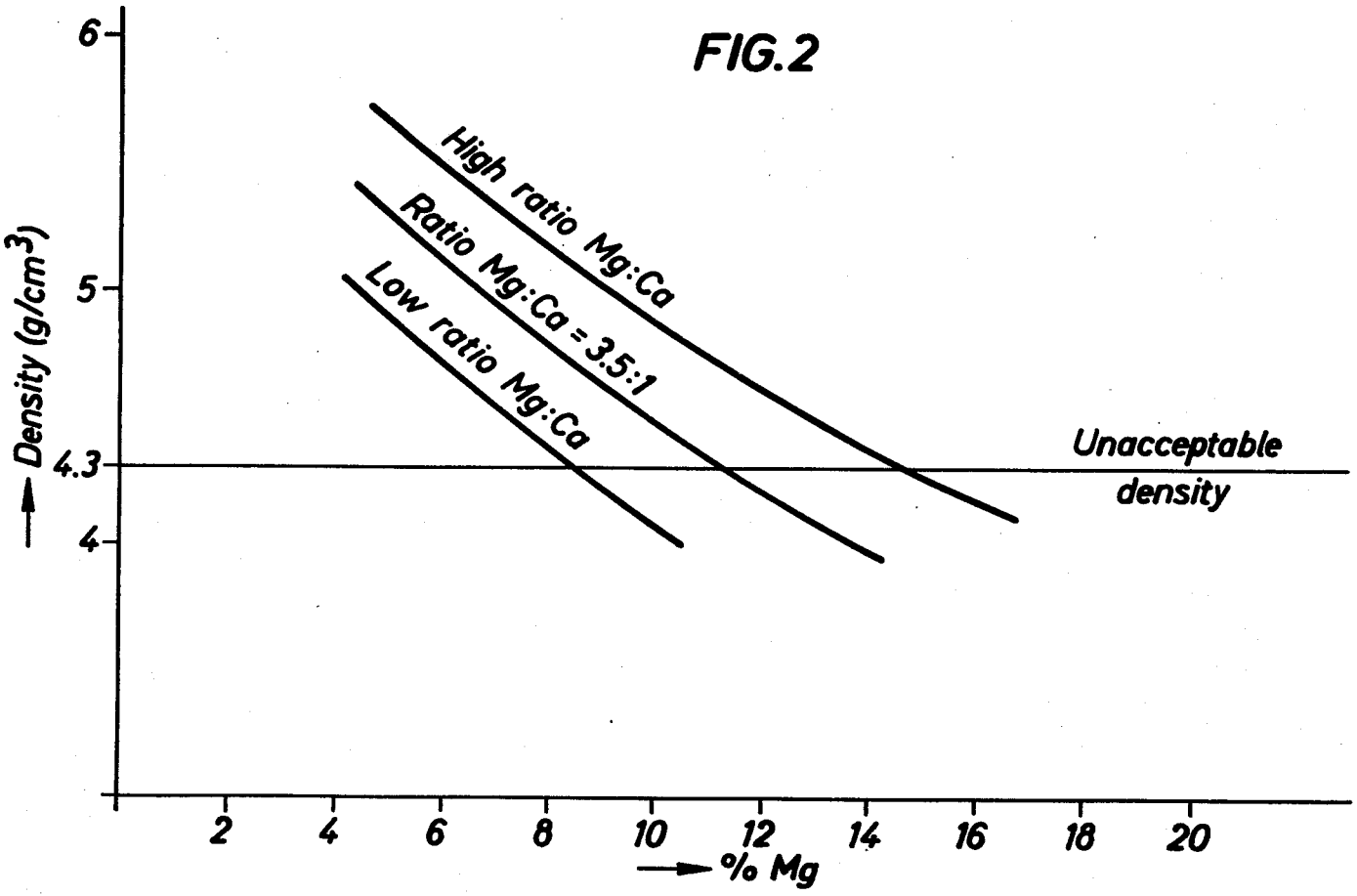

In order that the invention may be better understood, it will now be discussed with reference to the accompanying diagrammatic drawings in which:

FIG. 1 is a graph showing the general relationship between the content of magnesium at three different magnesium:calcium ratios in a compact and the violence of the reaction with the molten metal (measured on an arbitrary scale), and FIG. 2 is an idealised graph showing the general relationship between the density of the compact and the content of magnesium at certain magnesium:calcium ratios, with other factors, e.g. the absence of additives, compaction pressure and the like, kept the same.

It can be seen from FIG. 1 that with an infinitely high ratio of magnesium to calcium, i.e. no calcium, one can use only a low content of magnesium (at most 8%) before reaction violence becomes intolerable. With a little calcium, i.e., high Mg/Ca ratio, up to 11% magnesium can be included. Even more can be included by choosing a low Mg/Ca ratio, whereby the moderating effect of the calcium on reaction violence is increased. However, as can be seen from the graph of FIG. 2, with increasing content of calcium, i.e., decreasing Mg/Ca ratio, the density of the tablet is decreased, and that unless care is exercised the density of the tablet will fall below the value of 4.3 gm/cc, in which case the tablet cannot be used in an over-pour technique because it will tend to float to the surface of the molten metal before the treatment is complete. In practice the upper limit obtainable for the density of the treatment agent tends to be about 6.5 gm/cc.

Above a ratio of magnesium:calcium of 8:1, there is little moderation of the violence of the reaction between the magnesium and the molten iron. The upper limit for calcium can be as high as 1:1 but preferably less is used, e.g. a magnesium to calcium ratio of 4.5:1, more preferably 3.5:1, since the presence of the calcium tends to lower the density of the compact. As shown in the graph, there is an inverse relationship between the content of magnesium and calcium within the range in that with less magnesium, more calcium may be present.

The content of magnesium may be from 5% to 15% since within this range the risk of an unacceptably violent reaction from a tablet used in an over-pour technique is reduced in the presence of the defined proportion of calcium. It is impractical to use a lower content of magnesium, and it can be hazardous to use a higher content. The magnesium may be derived from any convenient source of magnesium metal or alloy and is of a particle size less than 0.7 mm. The purity of the magnesium is preferably at least 99%, and the particle grading is most preferably 0.15 to 0.40 mm.

Calcium may be incorporated in any convenient form, provided that it is not hazardous nor too stable to exert an effect on the violence of the reaction; preferably the calcium is introduced as an alloy, such as calcium silicide. Because of the ratio of magnesium:calcium the content of silicon even when introduced as calcium silicide will rarely exceed 10 to 15% and this is advantageous since the greater the concentration of silicon the greater the risk of undesired side effects.

Various types of iron powder may be used, for example sponge iron powder or steel powder. The purity should be at least 95% and preferably at least 98%, and as near to 100% as possible since impurities, mainly iron oxide and alumina, affect the compressibility of the sponge iron and steel powder and hence the obtainable density of the compacted body, and also the magnesium recovery values.

The weight of tablets needed to nodularise the iron satisfactorily will depend on the composition of the iron and on the magnesium content of the tablets but will usually be in the range of 0.5 to 3.0% by weight based on the weight of molten iron being treated.

In addition to iron, magnesium and calcium, the tablets may also contain small quantities of other elements which are normally added to molten iron on the production of nodular iron. Examples of such elements include alkaline earth metals other than calcium, rare earths and tin. These elements may be present in the tablets as alloys, e.g. Mg-Sn, Mg-Ba, Mg-Ce alloys, cerium mischmetall or cerium silicide or as salts. The tablets may also contain inoculating agents for cast iron such as silicon carbide or bismuth or fluxing agents such as magnesium fluoride or rare earth fluorides. In each case, however, care must be taken that the density of the tablets does not fall below the minimum value. The use of binders is unnecessary and should be avoided.

It is advantageous to include carbon in the treatment agent, for example, in the form of crystalline graphite, amorphous carbon or crushed carbon electrode scrap. The addition of up to 5%, preferably 2 to 4% by weight of carbon improves the compactability of the mixture and so helps to achieve the required high density. The incorporation of carbon also helps the physical breakdown of the treatment agent in the molten iron since it prevents particles of iron powder from sintering together.

Tablets of the treatment agent are preferably made by compacting a dry mixture of the ingredients, for example on a contra-rotating roll press, at a suitable pressure and temperature. The tablets may be of any convenient shape and size but preferably have a volume of 0.5 cc to 10 cc, and preferably have a high bulk density.

In practical over-pour tests done in a foundry it is observed that compared with magnesium ferrosilicon alloy there was less slag during nodularisation using a tablet of the invention, less reduction of molten metal temperature and the nodularised iron had an improved metallurgical structure. These advantages may be attributed in part to the fact that because a tablet containing little silicon is used, there is less formation of siliceous slag and hence less slagging, and because the content of magnesium can with safety be high, the violence of the reaction is reduced and less tablets are required, both of which contribute to a tendency for the molten metal temperature not to be reduced.

It is to be noted that treatment agents according to the present invention may be used in existing installations which comprise apparatus such as plunging bells to hold the treatment agent down. However, the treatment agents of the invention possess the great advantage that they may be used in simple "overpour" techniques, in which the treatment agent is simply placed on the base of a metallurgical vessel such as a ladle or crucible, and the cast iron or steel to be treated is simply poured into the vessel. If desired, in order to avoid the treatment agent being too violently displaced by the initial inrush of molten metal, it may be covered with e.g. iron or steel punchings. However, provided the density of the agent is at least 4.3 it is found that, whether the agent is covered or not at the commencement of pouring, although the tablets or the like of treatment agent eventually float up to the top, by the time they have done so, the magnesium reaction is finished and the nodularisation or other treatment is ended. Because the treatment agent of the invention has a density of at least 4.3 the residence time of the treatment agent in the molten metal in practice is sufficient to enable the magnesium content to be properly released within the molten metal, and not merely released as magnesium or magnesium oxide vapour at the upper surface of the molten metal.

The following examples will serve to illustrate the invention:

EXAMPLE 1

The following compositions by weight were prepared by mixing together the components:

| | | |
|---|---|---|
| (A) | (not according to the invention) | |
| | Sponge Iron (particle size less than 0.15mm, iron content 98.5%) | 92.5% |
| | Magnesium (particle size less than 0.35mm) | 7.5% |
| (B) | (according to the invention) | |
| | Sponge Iron (particle size less than 0.15mm iron content 98.5%) | 86.5% |
| | Magnesium (particle size less than 0.35mm | 7.5% |
| | Calcium Silicide (particle size less than 0.5mm) | 6.0% |

The compositions were formed into almond-shaped briquettes approximately 3 cm×2 cm×1.5 cm in size by means of a contra-rotating roll briquetting machine operating at a pressure of 5 tonne/cm.

Briquettes formed from composition A had a density of 5.80 g/cm$^3$ and briquettes formed from composition B had a density of 5.34 g/cm$^3$.

The tablets were tested as nodularising agents for cast iron using the following procedure:

Base iron for nodularisation was melted in a high-frequency coreless induction furnace, the charge materials having been chosen to give a melt out analysis of 3.5% carbon and 2.3% silicon. The molten iron was superheated to 1540° C. and tapped into a treatment ladle containing 2.45% by weight of the weight of iron to be treated of nodularising tablets covered with a layer of 1.8% or 2.5% by weight of the iron weight of steel punchings. Observations were made of the reaction violence as magnesium was evolved from the tablets.

The iron was analysed before and after treatment to determine the residual magnesium content and the magnesium recovery.

The results of the tests are tabulated below:

| Composition | Steel Cover | Reaction | % Residual Mg | % Mg Recovery |
|---|---|---|---|---|
| A | 1.8% | Violent | 0.045 | 24.5 |
| A | 2.5% | Violent | 0.040 | 21.7 |
| B | 1.8% | Mild | 0.051 | 27.7 |
| B | 2.5% | Mild | 0.053 | 28.5 |

EXAMPLE 2

The following composition (not according to the invention) was prepared by mixing together the components (percentage by weight):

| | | |
|---|---|---|
| (C) | Sponge Iron (particle size less than 0.15mm, iron content 87%) | 86.5% |
| | Magnesium (particle size less than 0.35mm | 7.5% |
| | Calcium silicide (particle size less than 0.5mm) | 6.0 |

The composition was formed into briquettes using the method described in Example 1, and the resulting briquettes were compared with briquettes of composition B of Example 1 as nodularising agents.

The composition C briquettes had a density of 3.4 g/cm$^3$ compared with a density of 5.34 g/cm$^3$ for the composition B briquettes.

When used to treat molten iron as described in Example 1 the composition C briquettes floated and reacted at the surface of the molten iron and the residual magnesium content of the iron was only 0.008%. In comparison the composition B briquettes resulted in a residual magnesium content of the iron of 0.051%.

EXAMPLE 3

The following composition by weight was prepared by mixing together the components:

| | | |
|---|---|---|
| (D) | Sponge Iron (particle size less than 0.15mm iron content 98.5%) | 66.5% |
| | Grey iron powder (particle size less than 0.25mm) | 20.0% |
| | Magnesium (particle size less than 0.35mm) | 7.5% |
| | Calcium Silicide (particle size less than 0.5mm) | 6.0% |

The composition was formed into briquettes using the method described in Example 1, and the resulting briquettes had a density of 5.3 g/cm$^3$.

The briquettes were used to produce nodular cast iron by means of the procedure described in Example 1. Reaction due to evolution of magnesium was mild and the residual magnesium content of the iron was 0.026%.

EXAMPLE 4

The following composition was prepared by mixing together the components (percentage by weight):

| | | |
|---|---|---|
| (E) | Steel Powder (particle size less than 0.5mm iron content 99%) | 82.5% |
| | Magnesium (particle size less than 0.35mm) | 10.0% |
| | Calcium silicide (particle size less than 0.50mm) | 7.5% |

The composition was formed into briquettes using the method described in Example 1, and the resulting briquettes had a density of 4.9 g/cm$^3$.

The briquettes were used to treat 1500 kg of molten iron at 1520° C., at an addition rate of 1.3% by weight. The briquettes were placed at the bottom of a ladle and covered with 1% by weight of the iron weight of steel punchings, and the molten iron was then poured into the ladle. Twenty-one such treatments were carried out and the average magnesium recovery was 24.5%.

EXAMPLE 5

The following compositions by weight were prepared by mixing together the components:

| | | |
|---|---|---|
| (F) | Steel powder (particle size less than 0.5 mm, iron content 99%) | 90.0% |
| | Magnesium (particle size less than 0.35mm) | 5.0% |
| | Calcium silicide (particle size less than 0.5mm) | 5.0% |
| (G) | Steel powder (particle size less than 0.5mm, iron content 99%) | 88.0% |
| | Magnesium (particle size less than 0.35mm) | 5.0% |
| | Calcium silicide (particle size less than 0.50mm) | 5.0% |
| | Crystalline graphite | 2.0% |

The compositions were formed into briquettes using the method described in Example 1.

Briquettes formed from compositions F had a density of 5.1 g/cm$^3$, and briquettes formed from composition G had a density of 5.6 g/cm$^3$.

Briquettes of each of the compositions were used to treat 1300 kg of molten iron at a temperature of 1510° C. at an addition rate of 2% by weight. The briquettes were placed at the bottom of a ladle and covered with 2% by weight of the iron weight of steel punchings, and the molten iron was then poured into the ladle. Composition F gave a magnesium recovery of 40.5% and composition G gave a magnesium recovery of 41.0%.

EXAMPLES 6 TO 20

The following formulations were made up and compacted into tablets having the densities specified. In each case the compacted tablet was used to nodularise cast iron, and satisfactory results were obtained without a violent reaction and with satisfactory magnesium recovery values. In each case the ingredients had the purity and particle size specified before.

| Example | Density | Magnesium % | Calcium Silicide % | Mg/Ca ratio (approx) | Iron % | Carbon % |
|---|---|---|---|---|---|---|
| 6 | 4.3 | 10 | 13.4 | 2.5:1 | 74.6 | 3.0 |
| 7 | 4.5 | 10 | 7.5 | 4.4:1 | 79.5 | 3.0 |
| 8 | 4.5 | 10 | 7.5 | 4.4:1 | 78.5 | 4.0 |
| 9 | 4.6 | 10 | 9.0 | 3.4:1 | 77.75 | 3.25 |
| 10 | 4.7 | 10 | 11.0 | 3.03:1 | 77.0 | 2 |
| 11 | 4.8 | 10 | 7.5 | 4.4:1 | 80.5 | 2.5 |
| 13 | 4.8 | 10 | 7.5 | 4.4:1 | 80.5 | 2 |
| 12 | 4.9 | 7.5 | 5.6 | 4.46:1 | 84.9 | 2 |
| 14 | 4.9 | 7.5 | 7.5 | 3.0:1 | 85.0 | 0 |
| 15 | 5.1 | 7.5 | 5.6 | 4.46:1 | 84.9 | 2 |
| 16 | 5.2 | 7.5 | 5.6 | 4.46:1 | 84.9 | 2 |
| 17 | 5.4 | 6.5 | 4.0 | 5.4:1 | 87.0 | 2.5 |
| 18 | 5.7 | 6.0 | 3.0 | 6.0:1 | 88.5 | 2.5 |
| 19 | 5.5 | 5.0 | 5.0 | 3.0:1 | 90.0 | 0 |
| 20 | 5.8 | 5.0 | 3.8 | 4.39:1 | 89.2 | 2.0 |

EXAMPLES 21 AND 22

Two further evaluations were done by testing tablets made according to the following conditions.

(21) Magnesium content 10%, calcium silicide content 7.5%, balance pure sponge iron, the Mg:Ca ratio being 4.4:1, the mixture being compacted to a density of 4.1 gm/cc. In use under foundry conditions, the tablet floated on the molten iron because of the low density and a recovery rate of only 7.5% was achieved. This is unacceptable.

(22) Magnesium content 10%, calcium silicide content 4%, carbon content 2%, balance pure sponge iron, the Mg:Ca ratio being 8.3:1 and the mixture being compacted to a density of 5.0 gm/cc. In use, under foundry conditions the reaction between the magnesium and molten metal was unacceptably violent, demonstrating that the limit of the Mg:Ca is about 8:1.

We claim:

1. A treatment agent which is a compacted mixture comprising particulate iron, magnesium and calcium, wherein (1) the magnesium content is 5 to 15% by weight
(2) the weight ratio of magnesium to calcium is in the range of from 1:1 to 8:1
(3) the iron has a purity of at least 95% by weight and a particle size of all less than 0.5 mm and
(4) the mixture is compacted into a body of density at least 4.3 gm/cm$^3$.

2. The treatment agent of claim 1 wherein the weight ratio of magnesium to calcium is in the range of 4.5:1 to 1:1.

3. The treatment agent of claim 1 wherein the magnesium is of particle size all less than 0.7 mm.

4. The treatment agent of claim 1 wherein the magnesium is of purity at least 99% by weight and all of particle size 0.15 to 0.40 mm.

5. The treatment agent of claim 1 wherein the calcium is present in the form of calcium silicide.

6. The treatment agent of claim 1 wherein the iron is in the form of sponge iron with a particle size all less than 0.2 mm.

7. The treatment agent of claim 1 wherein the iron is in the the form of steel with a particle size all less than 0.2 mm.

8. The treatment agent of claim 1 and including at least one component selected from the class consisting of alkaline earth metals other than calcium, rare earth metals and tin.

9. The treatment agent of claim 1 and including up to 5% by weight of carbon.

10. The treatment agent of claim 1 in the form of tablets each of volume 0.5 to 10 cm$^3$.

11. In the method of nodularising molten iron in the production of ductile iron which comprises locating in a metallurgical vessel a quantity of a treatment agent and pouring molten iron into the vessel, the improvement comprising using as the treatment agent a compacted mixture comprising particulate iron, magnesium and calcium, wherein (1) the magnesium content is 5 to 15% by weight
(2) the weight ratio of magnesium to calcium is in the range of from 1:1 to 8:1
(3) the iron has a purity of at least 95% by weight and a particle size of all less than 0.5 mm and
(4) the mixture is compacted into a body of density at least 4.3 gm/cm$^3$.

12. The method of claim 11 wherein the quantity of treatment agent placed in the vessel is 0.5 to 3.0% by weight of the molten metal to be treated.

13. In a method of deoxidising steel or desulphurising iron which comprises locating in a metallurgical vessel a quantity of treatment agent and pouring steel or iron respectively into the vessel, the improvement comprising using as the treatment agent a compacted mixture comprising particulate iron, magnesium and calcium, wherein (1) the magnesium content is 5 to 15% by weight
(2) the weight ratio of magnesium to calcium is in the range of from 1:1 to 8:1
(3) the iron has a purity of at least 95% by weight and a particle size of all less than 0.5 mm and
(4) the mixture is compacted into a body of density at least 4.3 gm/cm$^3$.

* * * * *